US011892230B1

(12) United States Patent
Arresta et al.

(10) Patent No.: US 11,892,230 B1
(45) Date of Patent: Feb. 6, 2024

(54) REFRIGERATOR APPLIANCE AND CORRESPONDING SHELVING SYSTEM

(71) Applicant: WHIRLPOOL CORPORATION, Benton Harbor, MI (US)

(72) Inventors: Giuseppina Arresta, Ternate (IT); Jakub Brzezina, Wroclaw (PL); Nataša Rikalo, Sesto Calende (IT); Piotr Rutkowski, Wroclaw (PL); Maurizio Valle, Varese (IT); Cem Yilmaz, Varese (IT)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/970,056

(22) Filed: Oct. 20, 2022

(51) Int. Cl.
*F25D 25/02* (2006.01)
*A47B 73/00* (2006.01)

(52) U.S. Cl.
CPC ..... *F25D 25/02* (2013.01); *A47B 73/008* (2013.01); *F25D 2331/803* (2013.01); *F25D 2331/809* (2013.01)

(58) Field of Classification Search
CPC ..... F25D 2331/803; F25D 25/02; F25D 2331/809; F25D 31/007; F25D 25/021; F25D 2331/805; F25D 23/04; A47B 73/008; A47B 73/004; A47B 88/975; A47B 57/586; A47B 57/585; A47B 73/00; A47B 2210/175
See application file for complete search history.

(56) References Cited

U.S. PATENT DOCUMENTS 2,327,379 A 8/1943 Willie
2,512,502 A 6/1950 Paschell
3,358,956 A * 12/1967 Thornton ..... A47B 96/062 211/184
3,579,710 A * 5/1971 Gartzke ..... A47H 15/04 16/93 R
3,868,021 A * 2/1975 Heinrich ..... E05D 15/0682 211/184

(Continued)

FOREIGN PATENT DOCUMENTS

CN 111380321 A * 7/2020
DE 29713629 U1 * 10/1997 ..... A47B 73/008

(Continued)

OTHER PUBLICATIONS

1 Whirlpool SP40 801/ LH 1 Built-in refrigerator with freezer cm. 69 h. 194—lt. 400.

*Primary Examiner* — Hiwot E Tefera
(74) *Attorney, Agent, or Firm* — Brooks Kushman P.C.

(57) ABSTRACT

A refrigerator shelving system includes a plate, an elongated support member, and a support brace. The plate has a front edge, a rear edge, and side edges extending between the front and rear edges. The elongated support member has a base secured to the rear edge of the plate. The elongated support member has a rail protruding upward from the base. The rail extends between the side edges of the plate. The support brace is disposed on a top of the plate. The support brace slidably engages the rail such that the support brace is slidable between the side edges. The support brace defines a notch configured to engage a bottle disposed on the top of the plate to restrict movement of the bottle.

20 Claims, 5 Drawing Sheets

(56) References Cited

U.S. PATENT DOCUMENTS

| | | | | |
|---|---|---|---|---|
| 5,332,611 | A * | 7/1994 | Shanok | F25D 25/02 49/501 |
| 5,358,128 | A | 10/1994 | Belokin et al. | |
| 6,386,379 | B1 | 5/2002 | Battaglia | |
| 6,932,449 | B2 | 8/2005 | Collins et al. | |
| 7,322,482 | B2 | 1/2008 | Caradonna | |
| 8,677,778 | B2 | 3/2014 | Jeon et al. | |
| 10,827,834 | B2 | 11/2020 | Wantland et al. | |
| 10,835,040 | B1 * | 11/2020 | El-Sayed | A47B 88/994 |
| 2006/0255704 | A1 | 11/2006 | Grobleben | |
| 2017/0321954 | A1 * | 11/2017 | Shrader | A47B 73/008 |
| 2021/0137265 | A1 * | 5/2021 | Liedtke | A47F 5/005 |

FOREIGN PATENT DOCUMENTS

| | | | | |
|---|---|---|---|---|
| DE | 19631373 | A1 * | 2/1998 | A47B 57/586 |
| DE | 202004004001 | U1 | 5/2004 | |
| DE | 102009027879 | A1 * | 1/2011 | A47B 73/008 |
| DE | 102011052087 | B4 | 1/2013 | |
| DE | 102016109955 | A1 * | 11/2017 | |
| EP | 1808104 | A1 * | 7/2007 | A47F 7/283 |
| KR | 100222990 | B1 | 10/1999 | |
| WO | WO-9805243 | A1 * | 2/1998 | A47B 73/008 |
| WO | 0165975 | A1 | 9/2001 | |
| WO | 2018145938 | A1 | 8/2018 | |

* cited by examiner

REFRIGERATOR APPLIANCE AND CORRESPONDING SHELVING SYSTEM

TECHNICAL FIELD

The present disclosure relates to an appliance such as a refrigerator.

BACKGROUND

In order to keep food fresh, a low temperature must be maintained within a refrigerator to reduce the reproduction rate of harmful bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

A refrigerator includes a cabinet, a planar shelf, an elongated support member, and a bottle holder. The cabinet defines an internal cavity. The planar shelf is disposed within the internal cavity. The planar shelf has a front edge disposed along an opening to the internal cavity, a rear edge positioned along a back of the internal cavity, and first and second opposing lateral sides extending between the front and rear edges. The planar shelf is configured to support items disposed with the internal cavity. The elongated support member has a base secured to the rear edge of the planar shelf. The elongated support member has a rail protruding upward from the base and extending in a direction from the first lateral side toward the second lateral side of the planar shelf. The bottle holder is disposed on a top of the planar shelf. The bottler holder slidably engages the rail such that the bottle holder is slidable between the first and second opposing lateral sides. The bottle holder defines a notch configured to engage bottles disposed on top of the planar shelf to restrict movement of the bottles along the top of the planar shelf.

A refrigerator shelving system includes a plate, an elongated support member, and a support brace. The plate has a front edge, a rear edge, and side edges extending between the front and rear edges. The elongated support member has a base secured to the rear edge of the plate. The elongated support member has a rail protruding upward from the base. The rail extends between the side edges of the plate. The support brace is disposed on a top of the plate. The support brace slidably engages the rail such that the support brace is slidable between the side edges. The support brace defines a notch configured to engage a bottle disposed on the top of the plate to restrict movement of the bottle.

A refrigerator shelving system includes a plate, a support member, and a rack. The plate has a plurality of edges defining a periphery of the plate. The support member has a base engaging a rear edge of the plurality of edges. The support member has a rail protruding upward from the base. The rail extends between side edges of the plurality of edges. The rack is disposed on a top of the plate. The rack slidably engages the rail such that the rack is slidable between the side edges. The rack defines a notch configured to receive a neck of a bottle disposed on the top of the plate.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
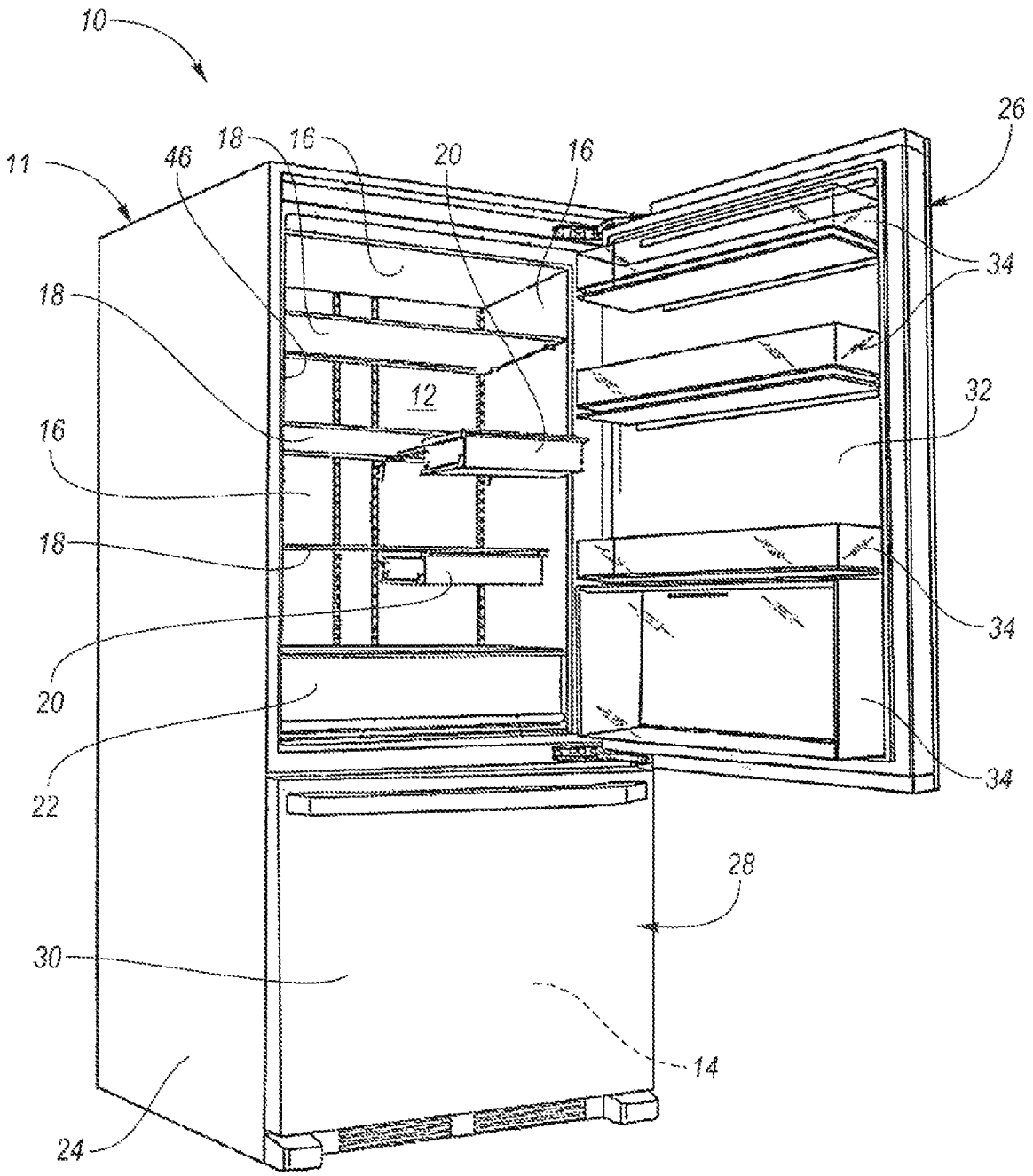
FIG. 1 is an isometric front view of a bottom-mount type refrigerator appliance with the refrigeration compartment door open.
Figure 2:
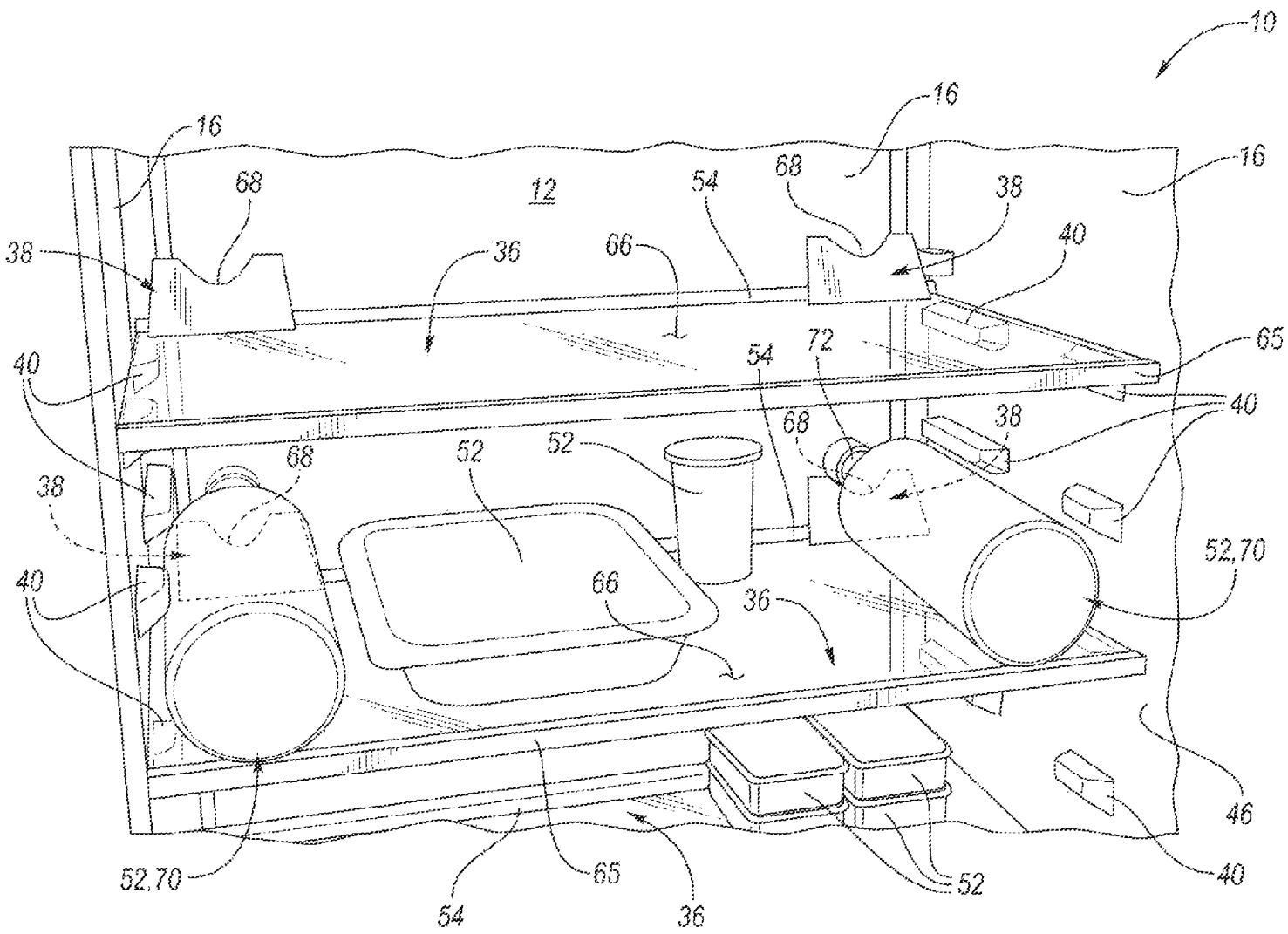
FIG. 2 is a partial isometric front view of the refrigerator with the door removed illustrating shelves and corresponding bottle holders disposed within an internal cavity of the refrigerator appliance.
Figure 3:
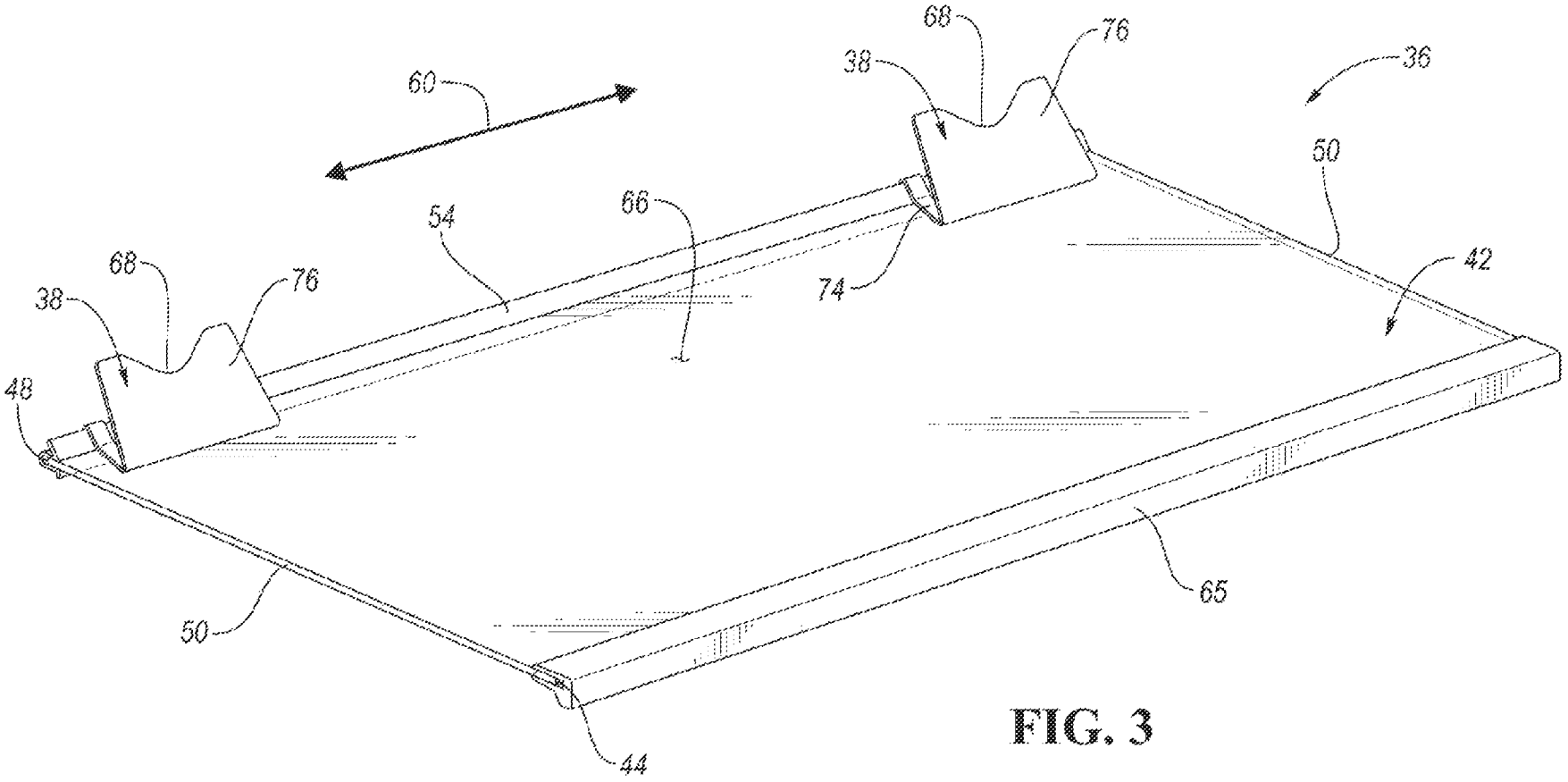
FIG. 3 is an isometric front view of one of the shelves and corresponding bottler holders.

Referring to FIG. 1, generally a refrigerator 10 of the two-door bottom mount type is illustrated. However, it should be understood that this disclosure could apply to any type of refrigerator, such as a side-by-side, French-Door Bottom Mount, or a top-mount type. As shown in FIG. 1, the refrigerator 10 may have a first internal storage chamber, internal cavity, or fresh food compartment 12 configured to refrigerate and not freeze consumables within the fresh food compartment 12, and a second internal storage chamber, internal cavity, or a freezer compartment 14 configured to freeze consumables within the freezer compartment 14 during normal use. The fresh food compartment 12 and freezer compartment 14 may be referred to as internal cavities that are defined by the walls of the refrigerator 10. It is generally known that the freezer compartment 14 is typically kept at a temperature below the freezing point of water, and the fresh food compartment 12 is typically kept at a temperature above the freezing point of water and generally below a temperature of from about 35° F. to about 50° F., more typically below about 38° F.

The refrigerator 10 includes one or more refrigeration loops (not shown) that are configured to cool the air the within the fresh food compartment 12 and the freezer compartment 14. The refrigeration loop includes at least a compressor, an evaporator that cools air being delivered to the fresh food compartment 12 and/or the freezer compartment 14, a condenser that rejects heat to ambient surroundings, and a thermal expansion valve. Fans may be utilized to direct air across the evaporator and the condenser to facilitate exchanging heat. The compressor and the fans may be connected to a controller. Sensors that measure the air temperature within the fresh food compartment 12 and the freezer compartment 14 may be in communication with the controller. The controller may be configured to operate the compressor, fans, etc. in response to the air temperature within the within the fresh food compartment 12 and the freezer compartment 14 being less than a threshold.

Such a controller may be part of a larger control system and may be controlled by various other controllers throughout the refrigerator 10, and one or more other controllers can collectively be referred to as a "controller" that controls various functions of the refrigerator 10 in response to inputs or signals to control functions of the refrigerator 10. The controller may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the refrigerator 10.

The refrigerator 10 includes panels or internal walls 16 that define the fresh food compartment 12 and the freezer compartment 14. The walls 16 may more specifically form an internal liner of the refrigerator 10. The walls 16 may include a rear or back wall, a top wall, a bottom wall, and two opposing side walls. One or more shelves 18 may be secured to the walls 16 within the fresh food compartment 12. One of more drawers 20 may be slidably secured to the shelves 18 or the walls 16 within the fresh food compartment 12. One or more crisper drawers 22 may be slidably secured to the shelves 18 or the walls 16 within the fresh food compartment 12. The crisper drawer 22 may more specifically be a drawer defining a storage space that is kept at a desired humidity that may be different from the remainder of the fresh food compartment 12, but that is optimal for maintaining freshness of fruits and vegetables.

The refrigerator 10 includes an outer shell, frame, or housing that comprises several exterior panels or walls 24. The outer shell, frame, or housing that comprises several exterior panels or walls 24 may also be referred to as the refrigerator cabinet wrapper. The exterior walls 24 may include a rear or back wall, a top wall, a bottom wall, and two side walls. The two side walls may be referred to as first and second side walls. An insulating material, such as an insulating foam, may be disposed between each exterior wall 24 and an adjacent corresponding interior wall 16 in order reduce the heat transfer from the ambient surroundings to the fresh food compartment 12 and the freezer compartment 14, which increases the efficiency of the refrigerator 10. Each exterior wall 24, adjacent corresponding interior wall 16, and the insulating material disposed between each exterior wall 24 and adjacent corresponding interior wall 16 may collectively be referred to as a single wall of the cabinet of the refrigerator.

The refrigerator 10 may have one or more doors 26, 28 that provide selective access to the interior volume of the refrigerator 10 where consumables may be stored. As shown, the fresh food compartment door is designated 26, and the freezer door is designated 28. The doors 26, 28 may be rotatably secured to the frame or housing of the refrigerator 10 by one or more hinges.

The doors 26, 28 may each include an exterior panel 30 and an interior panel 32 that is disposed on an internal side of the respective exterior panel 30 of each door 26, 28. The interior panels 32 may be configured to face the fresh food compartment 12 and freezer compartment 14 when the doors 26, 28 are in closed positions. The interior panels 32 may more specifically be door liners. An insulating material, such as an insulating foam, may be disposed between the exterior panels 30 and an adjacent corresponding interior panel 32 of each door 26, 28 in order reduce the heat transfer from the ambient surroundings and increase the efficiency of the refrigerator 10.

The doors 26, 28 may also include storage bins 34 that are able to hold food items or containers. The storage bins 34 may be secured to the interior panels 32 of each door 26, 28. Alternatively, the storage bins 34 may be integrally formed within or defined by the interior panels 32 of each door 26. 28. In yet another alternative, a portion of the storage bins 34 may be secured to the interior panels 32 the doors 26, 28, while another portion of the storage bins 34 may be integrally formed within or defined by the interior panels 32 the doors 26, 28. The storage bins 34 may include shelves (e.g., a lower surface upon, which a food item or container may rest upon) that extend from back and/or side surfaces of the interior panels 32 of the doors 26, 28.

Please note that the configuration of shelves and drawers in FIG. 1 is for illustrative purposes only and that the shelves and drawers in FIG. 1 may be rearranged to any desirable configuration.

Referring to FIGS. 2-6, shelves 36 and corresponding bottle holders 38 are illustrated. More specifically, the shelves 36 and corresponding bottle holders 38 are shown to be disposed within an internal storage chamber or internal cavity (e.g., the fresh food compartment 12) of the refrigerator 10. The shelves 36 may be referred to as shelving systems and the bottler holders 38 may be referred to support braces or racks. The shelves 36 may be supported along sides or side edges of the shelves 36 within the internal cavity via blocks 40 that extend inward into the internal cavity from opposing side walls 16 within the internal cavity.

Each shelf 36 includes a planar shelf portion or a plate 42. Each plate 42 includes a front edge 44 that is disposed along a front end of the internal cavity (e.g., the fresh food compartment 12) or along an opening 46 to the internal cavity. Each plate 42 also includes a rear edge 48 positioned along a back of the internal cavity or along a back wall 16 within the internal cavity. Each plate 42 includes opposing lateral sides or side edges 50 that each extend between the front edge 44 and the rear edge 48. The front edge 44, rear edge 48, and side edges 50 may be referred to as a plurality of edges that define a periphery of the plate 42. The opposing lateral sides or side edges 50 may be referred to as the first and second opposing lateral sides or side edges. The plates 42 and corresponding shelves 36 that include the plates 42 are supported along the side edges 50 of the plates 42 via the blocks 40. The plates 42 are configured to support items 52 (e.g., food stuffs, containers, bottles, etc.) disposed with the internal cavity (e.g., the fresh food compartment 12).

Each shelf 36 includes an elongated support member 54. Each elongated support member 54 has a base 56 secured to a rear edge 48 of one of the plates 42. Each elongated support member 54 also includes a rail 58 protruding upward from the base 56. Each rail 58 extends in a direction 60 from a first of the side edges 50 toward a second of the side edges 50 of a corresponding plate 42. Each rail 58 may also extend upward from a corresponding base 56 at an angle that is less than 90° (i.e., at an acute angle) relative to a top or top surface 66 of the corresponding plate 42, such that each rail 58 extends upward and toward the rear edge 48 of the corresponding plate 42.

Each base 56 may more specifically form C-channel that extends around or encapsulates the rear edge 48 of a corresponding plate 42. Each plate 42 may also define recesses 62 that are configured to receive protrusions 64 that extend inward from bases 56 within the C-channels to secure the positions of the elongated support members 54 onto corresponding plates 42. The plates 42 may be made from a glass material while the elongated support member 54 may be made from a metallic material or a rigid plastic material. A trim cover 65 may be disposed over the front edge 44 of each plate 42 to protect each plate 42. Each trim cover 65 may be made from a metallic material or a rigid plastic material.

Each bottle holder 38 is disposed on the top or top surface 66 of a corresponding plate 42. Each bottle holder 38 slidably engages a corresponding rail 58 such that each bottle holder 38 is slidable between the side edges 50 along direction 60. Each bottle holder 38 also defines a notch 68 configured to engage a bottle 70 that is disposed on the top or top surface 66 of the corresponding plate 42 to restrict movement of the bottle 70 along top or top surface 66 of the corresponding plate 42. More specifically, the notch is configured to receive a neck 72 of the bottle 70 that is disposed on the top or top surface 66 of the corresponding plate 42 to restrict movement of the bottle 70 along top or top surface 66 of the corresponding plate 42.

Each bottle holder 38 includes a lower member 74 that is configured to rest upon the top or top surface 66 of the corresponding plate 42 and an upper member 76 that protrudes upward from the lower member 74. The upper member 76 of each bottle holder 38 may define the corresponding notch 68 of each bottle holder 38. Each upper member 76 may also extend upward from a corresponding lower member 74 at an angle that is less than 90° (i.e., at an acute angle) relative to a top or top surface 66 of the corresponding plate 42 such each upper member 76 extends upward and toward the rear edge 48 of the corresponding plate 42.

Figure 4:
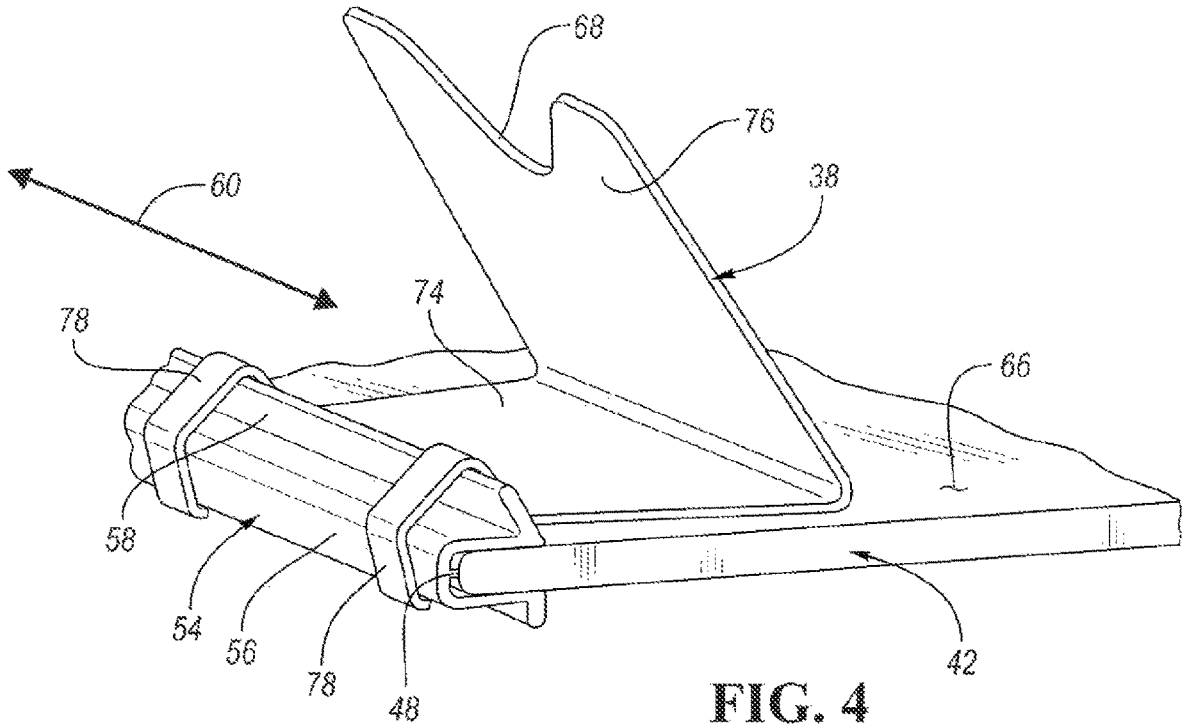
FIG. 4 is a rear isometric view of a portion of the one the shelves and a first configuration of one of the bottle holders.

A first configuration of one of the bottle holders 38 is illustrated in FIG. 4. In the first configuration, the bottle holder 38 includes hooks 78 that engage the rail 58 of a corresponding elongated support member 54. The hooks 78 may also engage the base 56 of the corresponding elongated support member 54. The engagement between the hooks 78 and the corresponding rail 58 and/or the corresponding base 56 (*i*) facilitates movement of the bottle holder 38 between the side edges 50 of a corresponding plate 42 along direction 60 and (ii) restricts movement of the bottle holder 38 between the front edge 44 and the rear edge 48 of the corresponding plate 42.

Figure 5:
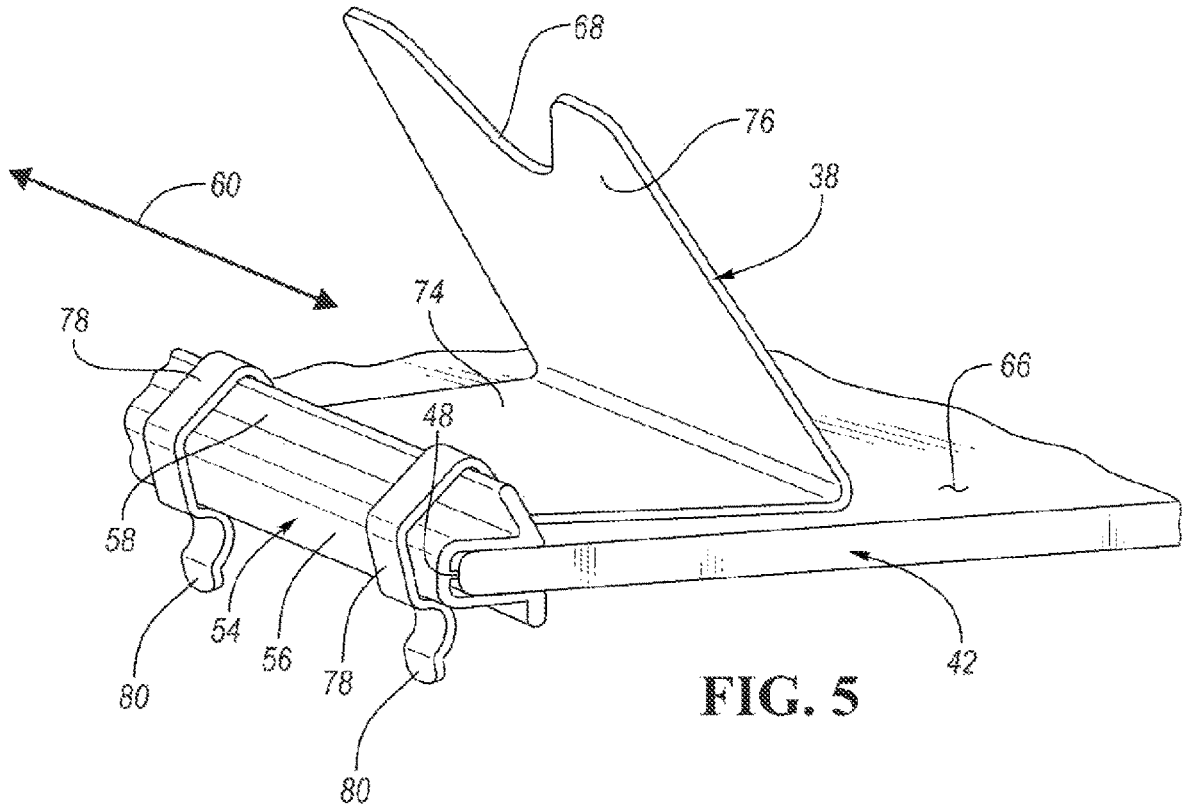
FIG. 5 is a rear isometric view of a portion of the one the shelves and a second configuration of one of the bottler holders.
Figure 6:
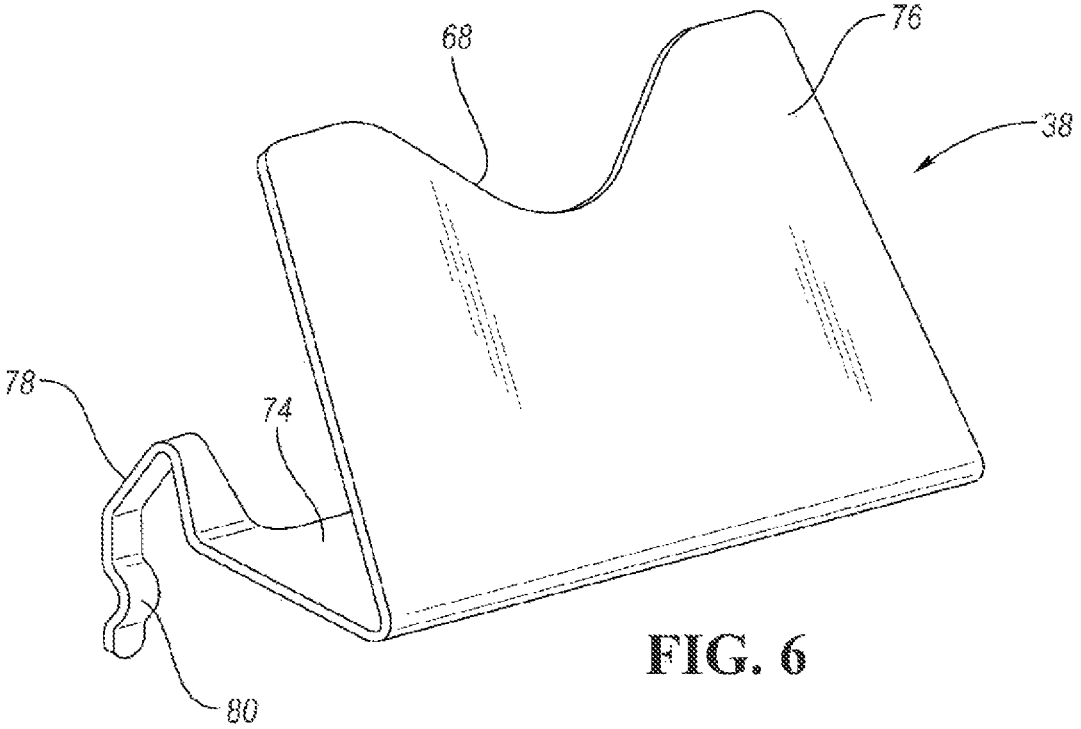
FIG. 6 is a front isometric view of the second configuration of one of the bottle holders.

A second configuration of one of the bottle holders 38 is illustrated in FIGS. 5-6. In the second configuration, the bottle holder 38 includes resilient clips 80 that are configured to snap onto the base 56 of a corresponding elongated support member 54. The clips 80 may extend from the bottom of hooks 78. The clips 80 may (i) connect the bottle holder 38 to the corresponding elongated support member 54 and (ii) restrict vertical movement of the bottle holder 38 relative to the corresponding elongated support member 54 and corresponding plate 42 (e.g., the clips 80 may restrict movement in a direction that is vertical and/or perpendicular to the top surface 66 of the corresponding plate 42). The clips 80 may be sufficiently rigid so as to maintain a vertical position of the bottle holder 38 relative to the corresponding elongated support member 54 but may also be sufficiently flexible to facilitate removal of the bottle holder 38 from the corresponding elongated support member 54 when a sufficient external force is applied (e.g., a force applied by a user) for the purpose of removing the bottle holder 38 from the corresponding elongated support member 54.

Figure 7:
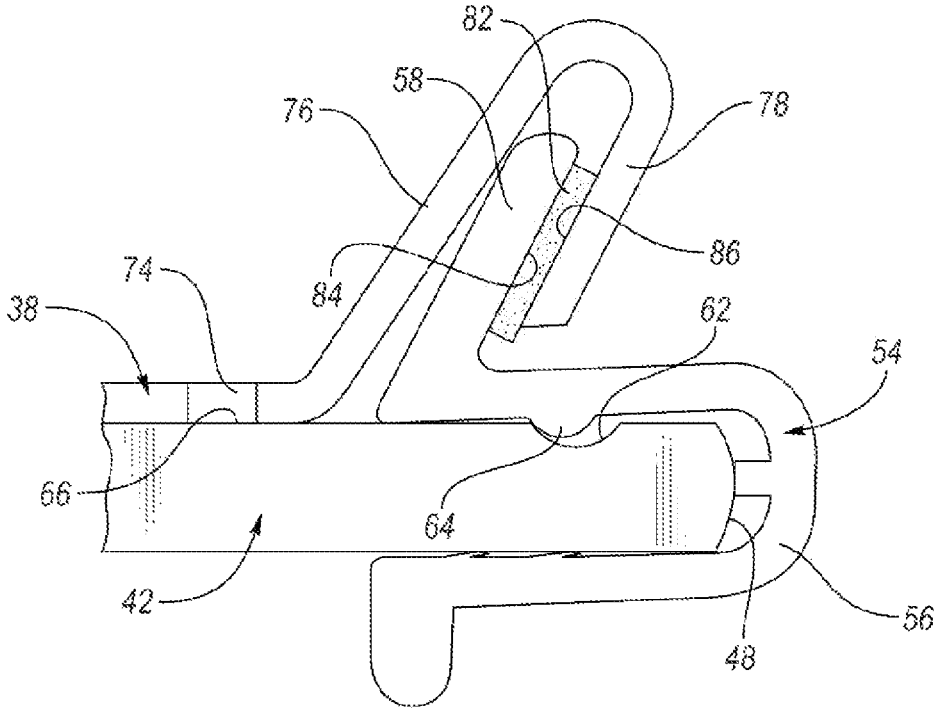
FIG. 7 is a side view of a portion of the one the shelves and a portion of a third configuration of one of the bottler holders.

A third configuration of one of the bottle holders 38 is illustrated in FIG. 7. In the third configuration, a magnet 82 is disposed between the hook 78 of the bottle holder 38 and a rail 58 of a corresponding elongated support member 54 to secure a position of the bottle holder 38 relative to the corresponding elongated support member 54. More specifically, the magnet 82 is configured to engage a back surface 84 of the rail 58 and an internal surface 86 of the hook 78 to secure the position of the bottle holder 38 relative to the corresponding elongated support member 54. The magnet 82 may be permanently fixed (e.g., via an adhesive) to either the hook 78 of the bottle holder 38 or to the rail 58 of the corresponding elongated support member 54. The magnet 82 may generate a force that is sufficiently strong to maintain a position of the bottle holder 38 relative to the corresponding elongated support member 54, so that the bottle holder 38 may maintain the position of a bottle 70 that is disposed on the top or top surface 66 of the corresponding plate 42, but may also be sufficiently weak to facilitate removal of the bottle holder 38 from corresponding elongated support member 54 when a sufficient external force is applied (e.g., a force applied by a user) for the purpose of removing the bottle holder 38 from the corresponding elongated support member 54.

It is noted that the hook 78 in the third configuration of the bottle holder 38 is shorter than the hooks 78 depicted in the first and second configurations of the bottle holder 38 such that the hook 78 engages the corresponding rail 58 but not the corresponding base 56. It should be understood, however, that the hook 78 in the third configuration of the bottle holder 38 may be longer so that it is the same as the hook 78 depicted in either the first or second configuration of the bottle holder 38.

It should be understood that the three configurations of the bottle holder 38 illustrated in FIGS. 4-7 have all the same subcomponents and functionality unless otherwise stated or illustrated herein.

It should be understood that the designations of first, second, third, fourth, etc. for any component, state, or condition described herein may be rearranged in the claims so that they are in chronological order with respect to the claims. Furthermore, it should be understood that any component, state, or condition described herein that does not have a numerical designation may be given a designation of first, second, third, fourth, etc. in the claims if one or more of the specific component, state, or condition are claimed.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A refrigerator comprising:

a cabinet defining an internal cavity;

a planar shelf (i) disposed within the internal cavity, (ii) having a front edge disposed along an opening to the internal cavity, (iii) having a rear edge positioned along a back of the internal cavity, (iv) having first and second opposing lateral sides extending between the front and rear edges, and (v) configured to support items disposed with the internal cavity;

an elongated support member having (i) a base secured to the rear edge of the planar shelf and (ii) a rail protruding upward from the base and extending in a direction from the first lateral side toward the second lateral side of the planar shelf; and a bottle holder (i) disposed on a top of the planar shelf, (ii) slidably engaging the rail such that the bottle holder is slidable between the first and second opposing lateral sides, and (iii) defining a notch configured to engage bottles disposed on top of the planar shelf to restrict movement of the bottles along the top of the planar shelf, wherein (a) the bottle holder includes hooks, (b) the bottle holder includes resilient clips extending downward from the hooks, (c) the hooks engage the rail and extend over an upper end of the rail, and (d) the clips snap onto the base and extend under a lower end of the base to connect the bottle holder to the elongated support member such that (I) the engagement between the hooks and the rail facilitates movement of the bottle holder between the first and second opposing lateral sides of the planar shelf, (II) engagement between the hooks and the rail restricts movement of the bottle holder between the front and rear edges of the planar shelf, and (III) engagement between the clips and the base restricts vertical movement of the bottle holder relative to the elongated support member.

2. The refrigerator of claim 1 further comprising a magnet configured to engage a back surface of the rail and an internal surface of the hook to secure a position of the bottle holder relative to the elongated support member.

3. The refrigerator of claim 1, wherein the rail extends upward from the base at an angle that is less than 90° relative to the top of the planar shelf such that rail extends upward and toward the rear edge of the planar shelf.

4. The refrigerator of claim 1, wherein bottle holder includes a lower member that is configured to rest upon the top of the planar shelf and an upper member that protrudes upward from the lower member, wherein the upper member defines the notch.

5. The refrigerator of claim 4, wherein the upper member extends upward from the lower member at an angle that is less than 90° relative to the top of the planar shelf such that upper member extends upward and toward the rear edge of the planar shelf.

6. The refrigerator of claim 1, wherein the base (i) defines a slot receiving the rear edge of the planar shelf and (ii) has a protrusion extending into the slot, and wherein the protrusion engages the rear edge of the planar shelf such that a back side of the base is spaced-apart from the rear edge of the planar shelf.

7. The refrigerator of claim 1, wherein (i) the base defines a slot receiving the rear edge of the planar shelf, (ii) a top surface of the planar shelf defines a recess, and (iii) the base has a protrusion extending downward and into the recess to secure the position of the elongated support member relative to the planar shelf.

8. A refrigerator shelving system comprising:

a plate having (i) a front edge, (ii) a rear edge, and (iii) side edges extending between the front and rear edges;

an elongated support member having (i) a base secured to the rear edge of the plate and (ii) a rail protruding upward from the base, wherein the rail extends between the side edges of the plate; and a support brace (i) disposed on a top of the plate, (ii) slidably engaging the rail such that the support brace is slidable between the side edges, and (iii) defining a notch configured to engage a bottle disposed on the top of the plate to restrict movement of the bottle, wherein (a) the support brace includes a hook, (b) the support brace includes a resilient clip extending downward from the hook, (c) the hook engages the base, engages the rail, and extends over a top of the rail, (d) the resilient clip snaps onto the base and extends under a lower end of the base to connect the support brace to the elongated support member such that (I) engagement between the hook and the rail and base facilitates movement of the support brace between the side edges of the plate, (II) engagement between the hook and the rail and base restricts movement of the support brace between the front and rear edges of the plate, and (III) engagement between the resilient clip and the base restricts vertical movement of the support brace relative to the elongated support member.

9. The refrigerator shelving system of claim 8 further comprising a magnet configured to engage a back surface of the rail and an internal surface of the hook to secure a position of the support brace relative to the elongated support member.

10. The refrigerator shelving system of claim 8, wherein the rail extends upward from the base at an angle that is less than 90° relative to the top of the plate such that rail extends upward and toward the rear edge of the plate.

11. The refrigerator shelving system of claim 8, wherein support brace includes a lower member that is configured to rest upon the top of the plate and an upper member that protrudes upward from the lower member, wherein the upper member defines the notch.

12. The refrigerator shelving system of claim 11, wherein the upper member extends upward from the lower member at an angle that is less than 90° relative to the top of the plate such that upper member extends upward and toward the rear edge of the plate.

13. The refrigerator shelving system of claim 8, wherein the base (i) defines a slot receiving the rear edge of the plate and (ii) has a protrusion extending into the slot, and wherein the protrusion engages the rear edge of the plate such that a back side of the base is spaced-apart from the rear edge of the plate.

14. The refrigerator shelving system of claim 8, wherein (i) the base defines a slot receiving the rear edge of the plate, (ii) a top surface of the plate defines a recess, and (iii) the base has a protrusion extending downward and into the recess to secure the position of the elongated support member relative to the plate.

15. A refrigerator shelving system comprising:

a plate having a plurality of edges defining a periphery of the plate;

a support member having (i) a base engaging a rear edge of the plurality of edges and (ii) a rail protruding upward from the base, wherein the rail extends between side edges of the plurality of edges; and a rack (i) disposed on a top of the plate, (ii) slidably engaging the rail such that the rack is slidable between the side edges, and (iii) defining a notch configured to receive a neck of a bottle disposed on the top of the plate, wherein (a) the rack includes a hook, (b) the rack includes a resilient clip extending downward from the hook, (c) the hook engages the rail and extends over an upper end of the rail, (d) the resilient clip snaps onto the base and extends under a lower end of the base to connect the rack to the support member such that (I) engagement between the hook and the rail facilitates movement of the rack between the side edges of the plurality of edges, (II) engagement between the hook and the rail restricts movement of the rack between a front edge and the rear edge of the plurality of edges, and (III) engagement between the resilient clip and the base restricts vertical movement of the rack relative to the support member.

16. The refrigerator shelving system of claim 15 further comprising a magnet configured to engage a back surface of the rail and an internal surface of the hook to secure a position of the rack relative to the support member.

17. The refrigerator shelving system of claim 15, wherein rack includes a lower member that is configured to rest upon the top of the plate and an upper member that protrudes upward from the lower member, wherein the upper member defines the notch.

18. The refrigerator shelving system of claim 17, wherein the upper member extends upward from the lower member at an angle that is less than 90° relative to the top of the plate such that upper member extends upward and toward the rear edge of the plurality of edges.

19. The refrigerator shelving system of claim 15, wherein the base (i) defines a slot receiving the rear edge of the plate and (ii) has a protrusion extending into the slot, and wherein the protrusion engages the rear edge of the plate such that a back side of the base is spaced-apart from the rear edge of the plate.

20. The refrigerator shelving system of claim 15, wherein (i) the base defines a slot receiving the rear edge of the plate, (ii) a top surface of the plate defines a recess, and (iii) the base has a protrusion extending downward and into the recess to secure the position of the support member relative to the plate.

* * * * *